United States Patent [19]

Ferguson

[11] Patent Number: 4,749,374

[45] Date of Patent: Jun. 7, 1988

[54] MARINE PROPULSION DEVICE POWER STEERING SYSTEM

[75] Inventor: Arthur R. Ferguson, Northbrook, Ill.

[73] Assignee: Outboard Marine Corporation, Waukegan, Ill.

[21] Appl. No.: 1,825

[22] Filed: Dec. 15, 1986

Related U.S. Application Data

[63] Continuation of Ser. No. 752,362, Apr. 3, 1985, Pat. No. 4,689,025.

[51] Int. Cl.[4] ..... B63H 21/14

[52] U.S. Cl. ..... 440/88; 74/15.63; 123/195 P; 123/198 C; 440/900

[58] Field of Search ..... 440/61, 88, 89, 75, 440/77, 86, 900; 123/41.31, 195 A, 195 P, 195 C, 198 C; 60/456; 74/15.63; 418/154, 102; 415/111, 53 R; 474/133

[56] References Cited

U.S. PATENT DOCUMENTS

| | | | |
|---|---|---|---|
| 3,483,763 | 12/1969 | Enters | 74/15.63 |
| 3,570,465 | 3/1971 | Masaoka | 440/77 X |
| 4,031,761 | 6/1977 | Fisher et al. | 74/15.63 |
| 4,493,661 | 1/1985 | Iwai | 440/77 |
| 4,516,918 | 5/1985 | Drutchas et al. | 418/102 X |
| 4,554,892 | 11/1985 | Amemori et al. | 123/195 P X |
| 4,588,385 | 5/1986 | Suzuki et al. | 440/88 |

FOREIGN PATENT DOCUMENTS

| | | | |
|---|---|---|---|
| 149893 | 8/1984 | Japan | 440/88 |
| 153692 | 9/1984 | Japan | 440/75 |

*Primary Examiner*—Joseph F. Peters, Jr.
*Assistant Examiner*—Paul E. Salmon
*Attorney, Agent, or Firm*—Michael, Best & Friedrich

[57] ABSTRACT

A marine propulsion device comprising a propulsion unit adapted to be mounted on the transom of a boat for pivotal movement relative to the transom about a steering axis, the propulsion unit including a rotatably mounted propeller, and an engine drivingly connected to the propeller and including a water jacket, a water pump connected to the water jacket for forcing cooling water through the water jacket to cool the engine, a fluid pump driven by the engine, a conduit communicating between the water jacket and the atmosphere, and a fluid cooler communicating with the conduit to receive cooling water from the water jacket and communicating with the fluid pump for cooling the fluid pumped thereby.

34 Claims, 5 Drawing Sheets

MARINE PROPULSION DEVICE POWER STEERING SYSTEM

RELATED APPLICATION

This is a continuation of application Ser. No. 752,362, filed July 3, 1985, now U.S. Pat. No. 4,689,025, granted Aug. 25, 1987.

BACKGROUND OF THE INVENTION

The invention relates to marine propulsion device power steering systems, and more particularly to arrangements for pumping hydraulic fluid to marine propulsion device power steering systems.

Attention is directed to the following U.S. Patents:

| INVENTOR | NUMBER | ISSSUED |
|---|---|---|
| Mueller, et al. | 2,447,958 | Aug. 24, 1948 |
| Mitchell | 2,254,380 | Sept. 2, 1941 |
| Koch | 2,234,917 | March 11, 1941 |
| Watson | 2,172,230 | Sept. 5, 1939 |
| Hunter | 1,963,913 | June 19, 1934 |
| Boyer | 395,208 | Dec. 25, 1888 |
| Rahlson | 3,026,738 | March 27, 1962 |
| Williams, et al. | 3,015,965 | Jan. 9, 1962 |
| Colden | 2,633,030 | March 31, 1953 |
| Emmons | 2,610,040 | Sept. 9, 1952 |
| Herman | 2,585,315 | Feb. 12, 1952 |
| Pichl | 4,119,054 | Oct. 10, 1978 |
| Brown, et al. | 4,300,872 | Nov. 17, 1981 |
| Engstrom | 3,781,137 | Dec. 25, 1973 |
| Ziegler | 3,250,240 | May 10, 1966 |
| Horning | 3,148,657 | Sept. 15, 1964 |
| Masaoka | 3,570,465 | Mar. 16, 1971 |
| Horn | 3,933,114 | Jan. 20, 1976 |
| Hiroshi Tado | 3,493,081 | Feb. 3, 1970 |
| Tado, et al. | 3,380,443 | April 30, 1968 |
| A. S. Bosma | 2,496,434 | Feb. 7, 1950 |
| Struttmann et al. | 4,489,475 | Dec. 25, 1984 |
| Hager | 4,351,636 | Sept. 28, 1982 |
| Jones | 4,028,964 | June 14, 1977 |
| Foster | 3,965,768 | June 29, 1976 |
| Castarede | 3,811,333 | May 21, 1974 |
| Stanford | 3,623,378 | Nov. 30, 1971 |
| Browning, Jr. | 3,358,521 | Dec. 19, 1967 |
| Rivers | 3,353,420 | Nov. 21, 1967 |
| Brewer | 3,071,980 | Jan. 8, 1963 |
| Kremser | 2,795,135 | June 11, 1957 |
| Sailer | 2,739,552 | March 27, 1956 |
| Marcellis | 1,847,720 | March 1, 1932 |
| Hemleb | 1,520,949 | Dec. 30, 1924 |
| Courtney | 1,275,398 | Aug. 13, 1918 |
| Cleves | 148,808 | March 24, 1874 |
| Mitchell | 80,650 | Aug. 4, 1868 |
| Hanke | 4,226,133 | Oct. 7, 1980 |
| James, et al. | 3,296,878 | Jan. 10, 1968 |
| Hanke | 3,122,028 | Feb. 25, 1964 |
| Zatko | 3,107,545 | Oct. 22, 1963 |
| Tann | 3,034,366 | May 15, 1962 |
| Firth, et al. | 3,027,773 | April 3, 1962 |
| Pilsner | 2,641,981 | June 16, 1953 |
| Fuchslocher | 2,555,189 | May 29, 1951 |
| Ballard | 2,502,243 | March 28, 1950 |
| Carlson | 2,480,222 | Aug. 30, 1949 |
| McKinney | 2,898,896 | Aug. 11, 1959 |

Attention is also directed to the following foreign patents: French Pat. No. 1,355,122; British Pat. Nos. 1,405,712; 589,987.

SUMMARY OF THE INVENTION

The invention provides a marine propulsion device comprising a propulsion unit adapted to be mounted on the transom of a boat for pivotal movement relative to the transom about a steering axis, the propulsion unit including a rotatably mounted propeller, and an engine drivingly connected to tne propeller, a water pump driven by the engine, a fluid pump driven by the engine, conduit means communicating between the water pump and the atmosphere, and a fluid cooler communicating with the conduit means to receive cooling water from the water pump and communicating with the fluid pump for cooling the fluid pumped thereby.

In one embodiment, the engine includes a water jacket, the water pump communicates with the water jacket, and the conduit means has an inlet end communicating with the water jacket, and an outlet end communicating with the atmosphere.

In one embodiment, tne conduit means includes a first conduit communicating between the water pump and the fluid cooler for providing cooling water to the fluid cooler, and a second conduit communicating between the fluid cooler and the atmosphere above the normal water level of the water in which the marine propulsion device operates so as to provide a signal that the water pump is operating.

In one embodiment, the device further comprises a hydraulic power steering system connected to the propulsion unit for causing pivotal steering movement of the propulsion unit about the steering axis, and second conduit means communicating between the power steering system and the fluid pump for supplying hydraulic fluid to the power steering system, and the fluid cooler communicates with the second conduit means.

The invention also provides a marine propulsion device comprising a propulsion unit adapted to be pivotally mounted on the transom of a boat for pivotal movement relative to the transom about a steering axis, the propulsion unit including a rotatably mounted propeller, and an engine drivingly connected to the propeller, and a pump including a reservoir housing defining a reservoir and a pump housing defining a pump chamber, an impeller rotatably mounted in the pump chamber, and a pump drive shaft driven by the engine and extending through the reservoir housing and having an end drivingly connected to the impeller.

In one embodiment, the pump chamber is located beneath the reservoir, and the pump drive shaft extends generally vertically through the reservoir housing and has a lower end drivingly connected to the impeller.

In one embodiment, the reservoir housing has a lower end, and the pump housing is mounted on the lower end of the reservoir housing with the pump chamber in communication with tne reservoir.

In one embodiment, the reservoir housing includes a wall surface defining a generally vertical drive shaft passage extending through the reservoir housing and having a lower end communicating with the pump chamber to allow fluid to flow into the drive shaft passage, the pump drive shaft extends through the drive shaft passage, and the pump further includes means sealing the upper end of the drive shaft passage around the drive shaft.

In one embodiment, the propulsion unit is also mounted for pivotal movement through a trim range relative to the transom about a generally horizontal tilt axis located forwardly of the pump, the pump has a foremost and lowermost portion, and the pump chamber is located in the foremost and lowermost portion of the pump so that the pump chamber is beneath the reservoir throughout the trim range.

The invention also provides a marine propulsion device comprising a propulsion unit including a rotatably mounted propeller, and an engine including an engine block, and a generally vertical crankshaft rotatably mounted in the engine block and having an upper end extending upwardly from the engine block, and a lower end drivingly connected to the propeller, a power takeoff pulley mounted on the upper end of the crankshaft, a pump mounted on the engine clock and including a generally vertical pump drive shaft having mounted thereon a drive shaft pulley, an idler pulley mounted on one of the engine block and the pump for rotation about a generally vertical idler pulley axis, and belt means extending around the power takeoff pulley, the drive shaft pulley, and the idler pulley and drivingly connecting the power takeoff pulley to the drive shaft pulley.

In one embodiment, the engine further includes a flywheel mounted on the upper end of the crankshaft, and the power takeoff pulley is mounted on the flywheel.

In one embodiment, the engine further includes a flywheel mounted on the upper end of the crankshaft above the power takeoff pulley, the flywheel has a circumference, and the belt means has a length greater than the circumference, or a length great enough to allow the belt to be removed without removing the flywheel.

The invention also provides a marine propulsion device comprising a propulsion unit including a rotatably mounted propeller, and an engine including an engine block having a side, and a generally vertical crankshaft rotatably mounted in the engine block and having a lower end drivingly connected to said propeller, a pump mounted on the side of the engine block, and belt drive means for driving the pump with the engine.

The invention also provides a marine propulsion device comprising a propulsion unit adapted to be pivotally mounted on the transom of a boat for pivotal movement relative to the transom about a steering axis, and for pivotal movement through a trim range relative to the transom about a generally horizontal tilt axis, the propulsion unit including a rotatably mounted propeller, and an engine drivingly connected to the propeller, and a pump mounted on the propulsion unit and driven by the engine, the pump including a housing assembly defining a reservoir and a pump chamber, and an impeller rotatably mounted in the pump chamber and driven by the engine, the pump being located relative to the tilt axis and the pump chamber being located relative to the reservoir such that the pump chamber is beneath the reservoir throughout the trim range.

The invention also provides a marine propulsion device comprising a propulsion unit adapted to be pivotally mounted on the transom of a boat for pivotal movement relative to the transom about a steering axis, and for pivotal movement through a trim range relative to the transom about a generally horizontal tilt axis, the propulsion unit including a rotatably mounted propeller, and an engine including an engine block having a side and a water jacket, and a generally vertical crankshaft rotatably mounted in the engine block and having an upper end extending upwardly from the engine block, and a lower end drivingly connected to the propeller. The device also comprises a water pump connected to the water jacket for forcing cooling water through the water jacket to cool the engine, and an oil pump mounted on the side of the engine block and including a housing assembly defining a reservoir and a pump chamber, an impeller rotatably mounted in the pump chamber, and a generally vertical pump drive shaft extending through the reservoir and having a lower end drivingly connected to the impeller, and an upper end having mounted thereon a drive shaft pulley, the pump being located relative to the tilt axis and the pump chamber being located relative to the reservoir such that the pump chamber is beneath the reservoir throughout the trim range. The device also comprises conduit means communicating between the water jacket and the atmosphere, and an oil cooler communicating with the conduit means to receive cooling water from the water jacket and communicating with the oil pump for cooling the oil pumped thereby. The device further comprises a power takeoff pulley mounted on the upper end of the crankshaft, an idler pulley mounted on one of the engine block and the pump for rotation about a generally vertical idler pulley axis, and belt means extending around the power takeoff pulley, the drive shaft pulley, and the idler pulley and drivingly connecting the power takeoff pulley to the drive shaft pulley.

The invention also provides a pump comprising a housing assembly including a reservoir housing defining a reservoir and a pump housing defining a pump chamber, an impeller rotatably mounted in the pump chamber, and a pump drive shaft extending through the reservoir housing and having an end drivingly connected to the impeller.

A principal feature of the invention is the provision of a marine propulsion device comprising, in part, a water pump, a fluid pump, telltale discharge conduit means communicating between the water pump and the atmosphere, and a fluid cooler communicating with the telltale discharge conduit means to receive cooling water from the water pump and communicating with the fluid pump for cooling the fluid pump thereby. This provides a simple means for cooling hydraulic fluid utilizing otherwise unused telltale discharge water.

Another principal feature of the invention is the provision of a pump as described above. Since the pump drive shaft extends through the reservoir housing, it is lubricated by the hydraulic fluid in the reservoir.

Another principal feature of the invention is the above described pulley system for powering the hydraulic fluid pump.

Another principal feature of the invention is the provision of a pump mounted on the side of the engine block, and belt drive means for driving the pump with the engine.

Another pricipal feature of the invention is the provision of a pump driven by the engine and including a housing assembly defining a reservoir and a pump chamber, the pump being located relative to the tilt axis and the pump chamber being located relative to the reservoir such that the pump chamber is beneath the reservoir throughout the trim range of movement of the propulsion unit. Because the pump chamber is always beneath the reservoir, hydraulic fluid will be pumped to the power steering system as long as there is any hydraulic fluid in the reservoir.

Other principal features and advantages of the invention will become apparent to those skilled in the art upon review of the following detailed description, claims, and drawings.

Figure 1:
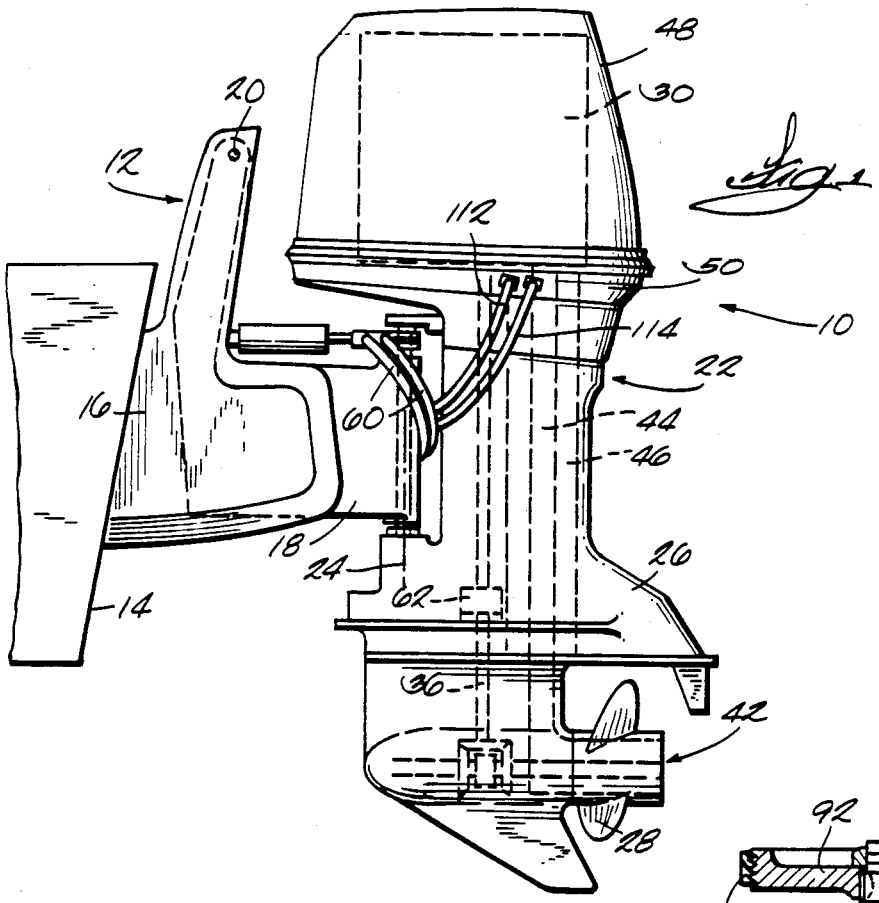
FIG. 1 is a port side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODYMENT

A marine propulsion device 10 embodying the invention is illustrated in the drawings. As best shown in FIG. 1, the marine propulsion device 10 comprises a mounting assembly 12 fixedly attached to the transom 14 of a boat. In the preferred embodiment, the mounting assembly 12 includes a transom bracket 16 fixedly attached to the transom 14, and a swivel bracket 18 pivotally mounted on the transom bracket 16 for pivotal movement of the swivel bracket 18 relative to the transom 14 about a generally horizontal tilt axis 20. As is known in the art, the swivel bracket 18 is movable about the tilt axis 20 through a trim range and a tilt range.

The marine propulsion device 10 also comprises a propulsion unit 22 pivotally mounted on the swivel bracket 18 for pivotal movement of the propulsion unit 22 relative to the swivel bracket 18 about a generally vertical steering axis 24. The propulsion unit 22 includes a lower unit 26 including a rotatably mounted propeller 28, and an internal combustion engine 30 mounted on the lower unit 26. In the preferred embodiment, the engine 30 includes an engine block 32 (shown in outline in FIGS. 2 and 3), and a generally vertical crankshaft 34 (FIGS. 3 and 8) rotatably mounted in the engine block 32 and having an upper end extending upwardly from the engine block 32, and a lower end drivingly connected to the propeller 28 by a drive train 36. The engine 30 also includes a flywheel 38 mounted on the upper end of the crankshaft 34, and a water jacket 40 (shown schematically in FIG. 2).

The propulsion unit 22 preferably further includes exhaust means including an outlet opening 42 in the propeller 28, an exhaust passage 44 communicating between the engine 30 and the outlet opening 42, and means defining a second or exhaust water jacket 46 surrounding the exhaust passage 44 for cooling the exhaust gases therein.

The marine propulsion device 10 further comprises a housing surrounding the engine and including upper and lower motor covers 48 and 50, respectively.

Figure 9:
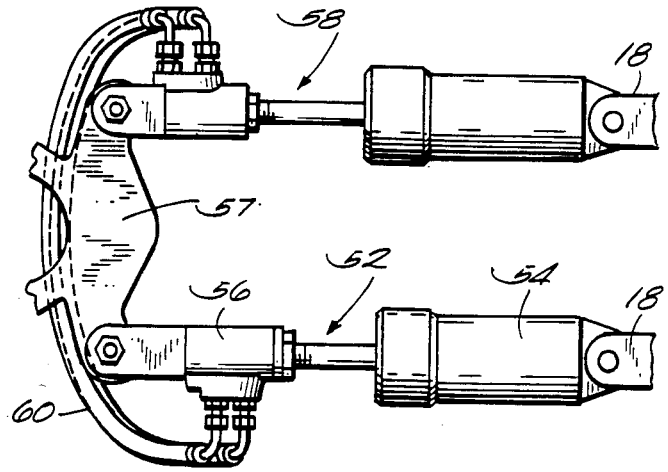
FIG. 9 is a partial top view of the power steering system.
Figure 10:
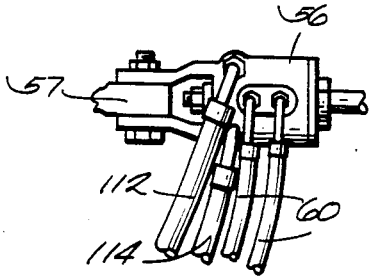
FIG. 10 is a side elevational view of the spool valve of the power steering system.

The marine propulsion device 10 further comprises (see FIGS. 1, 9 and 10) a hydraulic power steering system connected between the propulsion unit 22 and the swivel bracket 18 for causing pivotal steering movement of the propulsion unit 22 about the steering axis 24. While various suitable power steering systems can be used, in the preferred embodiment, as best shown in FIGS. 9 and 10, the power steering system includes a first hydraulic assembly 52 including an actuating assembly 54 connected to the swivel bracket 18 and controlled by a remote helm (not shown), and a spool valve assembly 56 connected to a steering arm 57 fixedly attached to the propulsion unit 22. The spool valve assembly 56 is actuated by the actuating assembly 54. The power steering system also includes a second hydraulic assembly 58 connected between the swivel bracket 18 and the steering arm 57 for causing pivotal steering movement of the propulsion unit 22. The power steering system further includes hydraulic fluid conduits 60 communicating between the spool valve assembly 56 and the second hydraulic assembly 58 for actuation thereof. An example of such a power steering system is described in greater detail in Ferguson U.S. patent application Ser. No. 614,815, filed May 29, 1984.

The marine propulsion device 10 further comprises a water pump 62 (shown schematically in FIG. 1) connected to the water jacket 40 for forcing cooling water through the water jacket 40 to cool the engine 30. In the preferred embodiment, the water pump 62 is located in the lower unit 26 and is driven by the drive train 36. This construction is known in the art.

Figure 5:
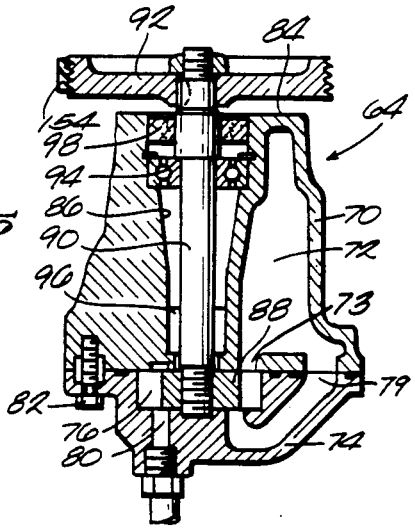
FIG. 5 is an enlarged cross-sectional view taken along line 5—5 in FIG. 4.
Figure 2:
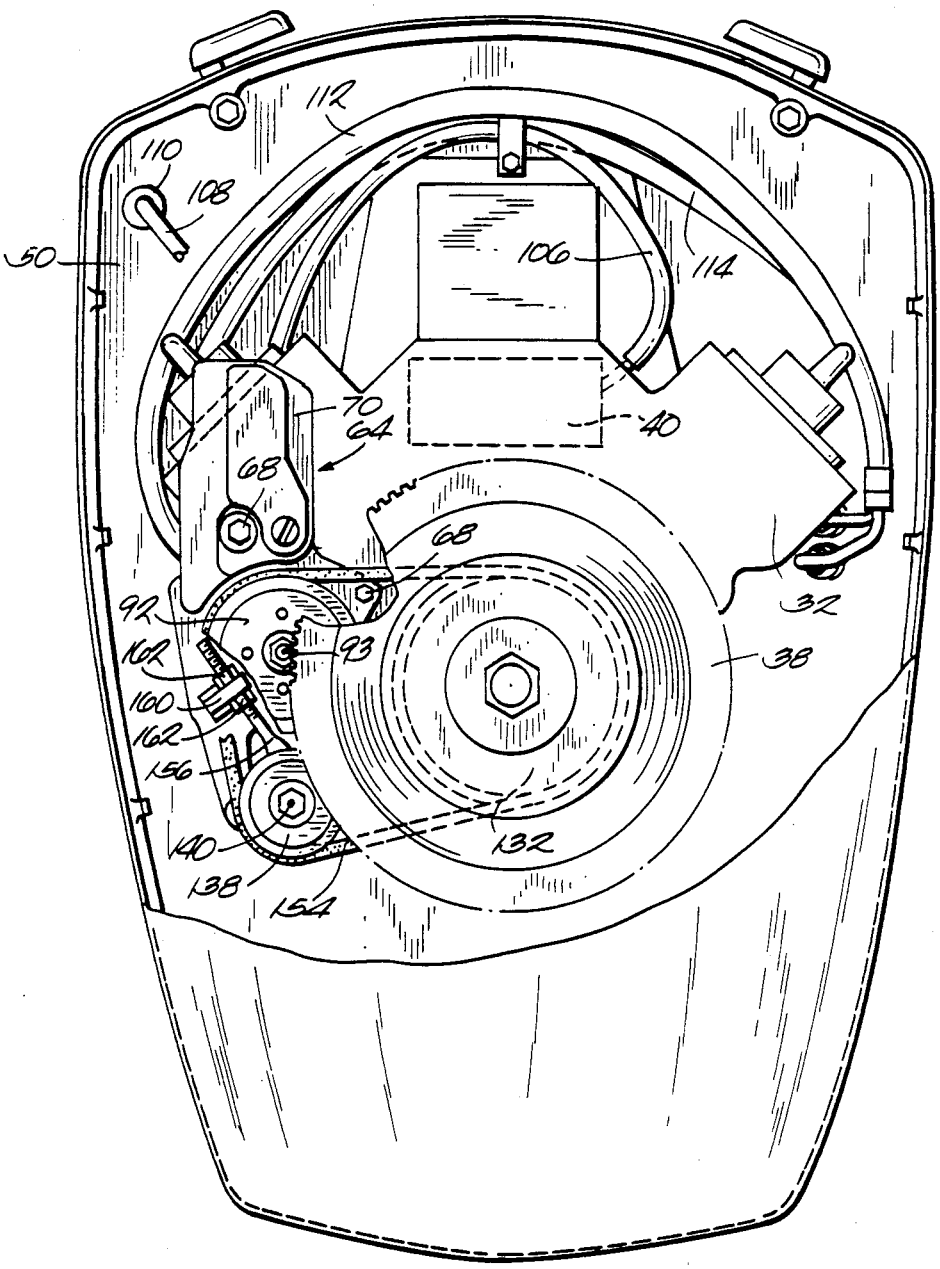
FIG. 2 is an enlarged top view, partially cut away, of the marine propulsion device.

The marine propulsion device 10 further comprises (see FIGS. 2–5) a pump 64 for supplying hydraulic fluid or oil to the power steering system. In the preferred embodiment, the pump 64 is removably mounted on the side of the engine block 32 by a bolt 66 and bolts 68. While one of the bolts 68 is beneath the flywheel 38, that bolt 68 can be removed without removing the flywheel 38. Thus, the pump 64 can be removed without removing the flywheel 38. The pump 64 includes a housing assembly including a reservoir housing 70 defining a reservoir 72, and a pump housing 74 defining a pump chamber 76. The reservoir housing 70 includes (see FIG. 3) a reservoir inlet 78 communicating with the reservoir 72 and a pump inlet 73 communicating between the reservoir 72 and the pump chamber 76, and the pump housing 74 includes (see FIGS. 3 and 5) a pump inlet 79 communicating between the reservoir 72 and the pump chamber 76, and a pump outlet 80 communicating with the pump chamber 76. Preferably, the pump housing 74 is mounted on the lower end of the reservoir housing 70 by a bolt or bolts 82 with the pump inlet 79 in communication with the reservoir 72, as best shown in FIG. 5. As also best shown in FIG. 5, the reservoir housing 70 includes an exterior wall surface 84 which turns inwardly to define a generally vertical drive shaft passage 86 extending through the reservoir housing 70 and having a lower end communicating with the pump chamber 76 to allow hydraulic fluid to flow into the drive shaft passage 86 from the pump chamber 76. The pump 64 further includes an impeller 88 rotatably mounted in the pump chamber 76, and a generally vertical pump drive shaft 90 extending through the drive shaft passage 86 and thus through the reservoir housing 70 and having a lower end drivingly connected to the impeller 88, and an upper end having mounted thereon a drive shaft pulley 92. Preferably, the drive shaft 90 is rotatably supported by upper and lower bearings 94 and 96, respectively. In the preferred embodiment, as best shown in FIG. 2, the axis 93 of the pump drive shaft 90 is located outside of the periphery of the flywheel 38, and the periphery of the pulley 92 overlaps the periphery of the flywheel 38. Preferably, the pump 64 also includes (see FIG. 5) means 98 sealing the upper end of the drive shaft passage 86 around the drive shaft 90. Hydraulic fluid from the pump chamber 76 flows upwardly into the passage 86 and lubricates the pump drive shaft 90, and the sealing means 98 prevents the hydraulic fluid from escaping from the drive shaft passage 86.

Figure 3:
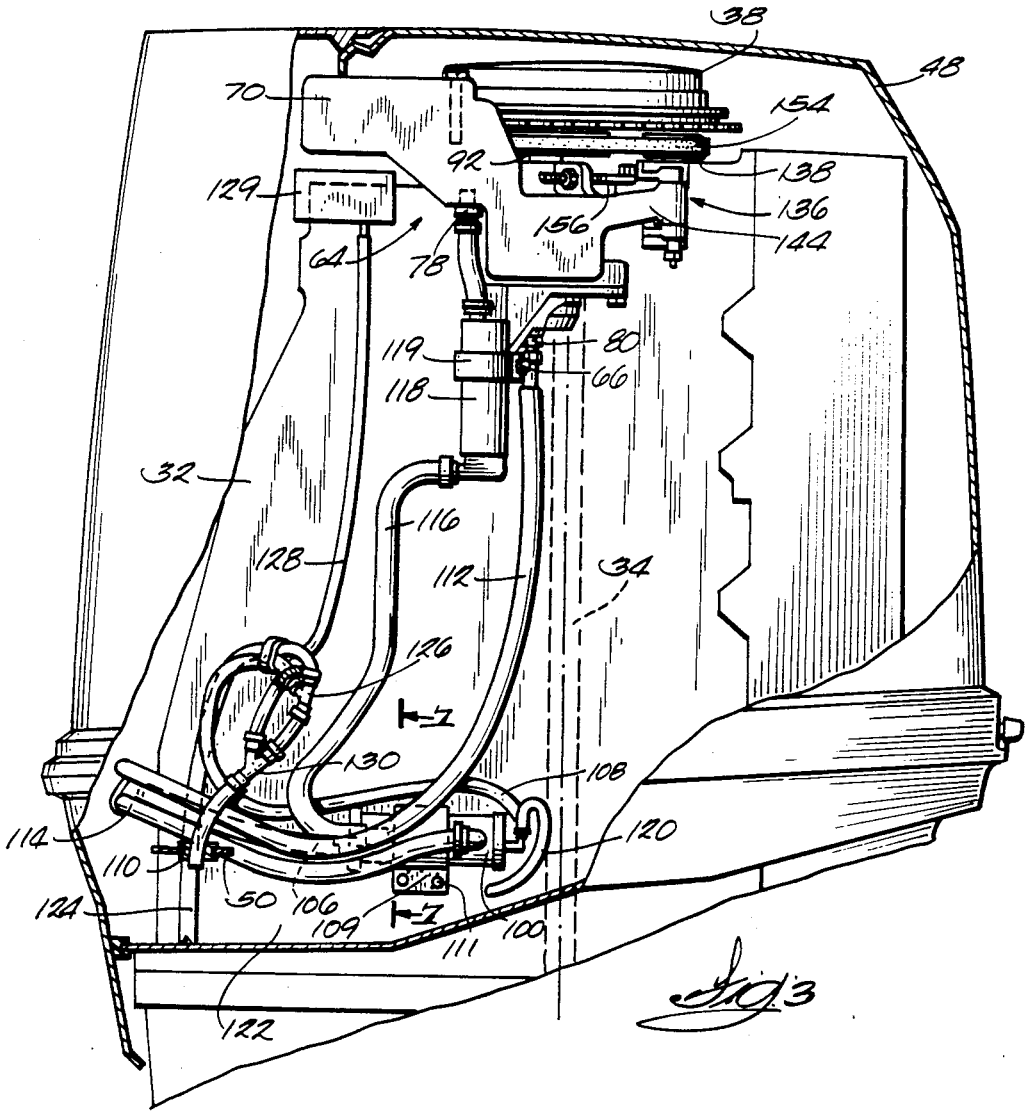
FIG. 3 is an enlarged side elevational view, partially cut away, of the starboard side of the marine propulsion device.

Preferably, the pump 64 has a foremost and lowermost portion wherein the pump chamber 76 is located, as best shown in FIG. 3. Accordingly, since the tilt axis 20 is located forwardly of the pump 64, the pump chamber 76 is beneath the reservoir 72 throughout the trim range of movement of the propulsion unit 22, and throughout the range of normal rolling motion of the boat. As long as the pump chamber 76 is beneath the reservoir 72, hydraulic fluid will be supplied to the power steering system provided there is hydraulic fluid in the reservoir 72.

Figure 7:
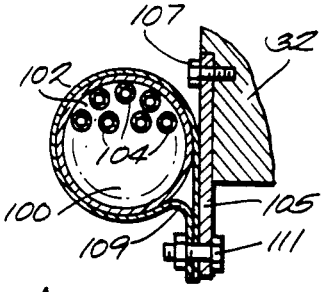
FIG. 7 is an enlarged cross-sectional view taken along line 7—7 in FIG. 3.

The marine propulsion device 10 further comprises conduit means communicating between the water pump 62 and the atmosphere, and a hydraulic fluid or oil cooler 100 communicating with the conduit means to receive cooling water from the water pump 62 and communicating with the pump 64 for cooling the hydraulic fluid pumped thereby. In the preferred embodiment, as best shown in FIG. 7, the fluid cooler 100 includes a fluid chamber or passage 102 communicating with the pump 64, and a plurality of water passages 104 extending through the fluid chamber 102 and communicating with the conduit means. Preferably, the fluid cooler 100 is mounted on the side of the engine block 32, as best shown in FIGS. 3 and 7. More particularly, in the illustrated construction, a plate 105 is mounted on the side of the engine block 32 by bolts 107, and a band clamp 109 is secured around the cooler 100 and is secured to the plate 105 by nuts and bolts 111.

In the preferred embodiment, the conduit means communicating between the water pump 62 and the atmosphere includes (see FIGS. 2 and 3) a first conduit 106 communicating between the water pump 62 and the fluid cooler water passages 104 for providing cooling water to the fluid cooler 100, and (see FIG. 3) a second conduit 108 communicating between the fluid cooler 100 and the atmosphere above the normal water level of the water in which the marine propulsion device 10 operates so as to provide a signal that the water pump 62 is operating. Thus, the conduit means provides what is known in the art as a telltale discharge. As best shown in FIG. 2, the inlet end of the first conduit 106 preferably communicates with the water jacket 40, and, as best shown in FIG. 3, the outlet end of the second conduit 108 extends through a grommet 110 seated in an opening in the lower motor cover 50.

The marine propulsion device 10 further comprises second conduit means communicating between the power steering system and the pump 64 for supplying hydraulic fluid to the power steering system. Preferably, the second conduit means includes (see FIGS. 1–3 and 10) a supply conduit 112 communicating between the hydraulic fluid pump 64 and the spool valve assembly 56 of the power steering system, a first return conduit 114 communicating between the spool valve assembly 56 and the fluid cooler 100, and a second return conduit 116 (see FIG. 3) communicating between the fluid cooler 100 and the fluid pump 64. Thus, the hydraulic fluid returning from the power steering system passes through the fluid cooler 100 before returning to the pump 64. In the preferred embodiment, the marine propulsion device 10 further comprises a filter 118 communicating with the second return conduit 116 upstream of the pump 64. This is best shown in FIG. 3. Preferably, the filter 118 is mounted on the pump 64 by a band clamp 119 secured to the pump 64 by the bolt 66.

As best shown in FIG. 2, the first conduit 106 communicates with the water jacket 40 at a point on the upper port side of the engine block 32 and extends around the rear of the engine block 32 to the fluid cooler 100 on the starboard side. The supply conduit 112 extends around the rear of the engine 30 from the pump outlet 80 and through the lower motor cover 50 on the port side of the engine 30, and then between the propulsion unit 22 and the swivel bracket 18 (see FIG. 1) to the starboard side of the engine 30 where it communicates with the spool valve assembly 56 (see FIG. 10). The first return conduit 114 extends from the spool valve assembly 56 to the fluid cooler 100 along a path parrallel to the path of the supply conduit 112.

The marine propulsion device 10 further comprises (see FIG. 3) third conduit means 120 communicating between the fluid cooler 100 and the exhaust water jacket 46 for draining the water from the fluid cooler 100 into the exhaust water jacket 46 when the propulsion unit 22 is tilted upwardly for storage. Preferably, the third conduit means 120 is considerably smaller than the second conduit 108 so that an insignificant amount of water flows out of the fluid cooler 100 through the third conduit means 120 during normal operation of the marine propulsion device 10. However, when the marine propulsion device 10 is not operating (so that the water pump 62 is not operating) and is tilted upwardly for storage, any water in the fluid cooler 100 will drain through the third conduit means 120.

In the preferred embodiment, the lower motor cover 50 includes (see FIG. 3) a portion defining a chamber 122 whicn may collect water, and the marine propulsion device 10 further comprises siphon means for removing water from the chamber 122. In the illustrated construction, as best shown in FIG. 3, the siphon means includes a siphon conduit 124 having an inlet end positioned in the chamber 122, and a discharge end communicating with the second conduit 108 via a Y joint 126. Therefore, in the event of water in the chamber 122, the flow of water through the second conduit 108 generates water flow through the siphon conduit 124 into the second conduit 108 so as to drain the chamber 122. Such siphon means is described in greater detail in Bland U.S. Pat. No. 4,403,972, issued Sept. 13, 1983.

In the preferred embodiment, the marine propulsion device 10 further comprises (see FIG. 3) fourth conduit means 128 having an inlet end communicating with a cooling system control valve 129 (shown schematically in FIGS. 3 and 11) as disclosed in Flaig U.S. Pat. No. 4,457,727, issued July 3, 1984, which is incorporated herein by reference. The fourth conduit means 128 also has a discharge end communicating with the second conduit 108 via a Y joint 130.

Figure 8:
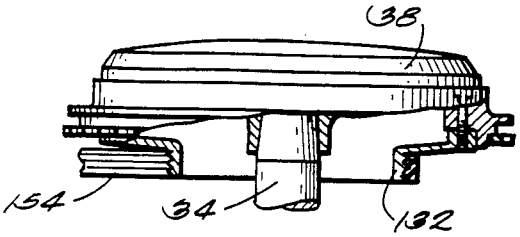
FIG. 8 is a side elevational view, partially cut away, of the flywheel and power takeoff pulley.

The marine propulsion device 10 further comprises (see FIGS. 2, 4 and 8) a power takeoff pulley 132 mounted on the upper end of the crankshaft 34. In the preferred embodiment, the power takeoff pulley 132 is mounted on the underside of the flywheel 38 by bolts 134, as best shown in FIG. 8. It should be understood that in alternative embodiments of the invention the power takeoff pulley 132 need not be mounted on the flywheel 38 and can be mounted either above or below the flywheel 38. Also, the pump 64 can be driven by other drive means.

Figure 6:
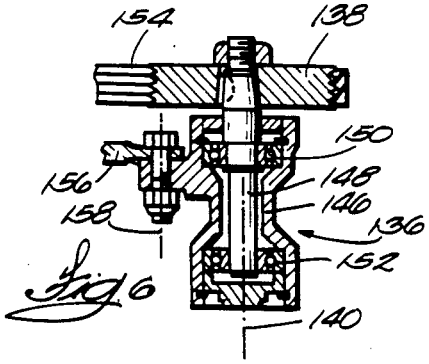
FIG. 6 is an enlarged cross-sectional view taken along line 6—6 in FIG. 4.

The marine propulsion device 10 further comprises (see FIGS. 2–4 and 6) an idler assembly 136 having an idler pulley 138 rotatably mounted thereon for rotation about a generally vertical idler pulley axis 140. The idler assembly 136 is best shown in FIG. 6. Preferably, as best shown in FIG. 2, the idler axis 140 is located outside of the flywheel periphery, and the periphery of the idler pulley 138 overlaps the flywheel periphery. While the idler assembly 136 can be mounted on either the engine block 32 or the pump 64, in the preferred embodiment, the idler assembly 136 is pivotally mounted on the pump 64 for pivotal movement relative to the pump 64 about a generally vertical axis 142 (FIGS. 2 and 4) spaced from the idler pulley axis 140. In the illustrated construction, the idler assembly 136 is mounted on an arm 144 extending forwardly from the reservoir housing 70. The idler assembly 136 includes (see FIG. 6) an idler housing 146, and an idler shaft 148 rotatably supported in the idler housing 146 by upper and lower bearings 150 and 152 and having an upper end with the idler pulley 138 mounted thereon.

The marine propulsion device 10 further comprises belt means extending around the power takeoff pulley 132, the drive shaft pulley 92, and the idler pulley 138 for drivingly connecting the power takeoff pulley 132 to the drive shaft pulley 92 for driving the pump 64. In the preferred embodiment, the belt means includes a poly-V belt 154. Preferably, the flywheel 38 has a circumference, and the belt 154 has a length such that the belt 154 can be removed without removing the flywheel 38. Furthermore, the drive shaft pulley 92 and the idler pulley 138 have circumferences less than the circumference of the flywheel 38.

Figure 4:
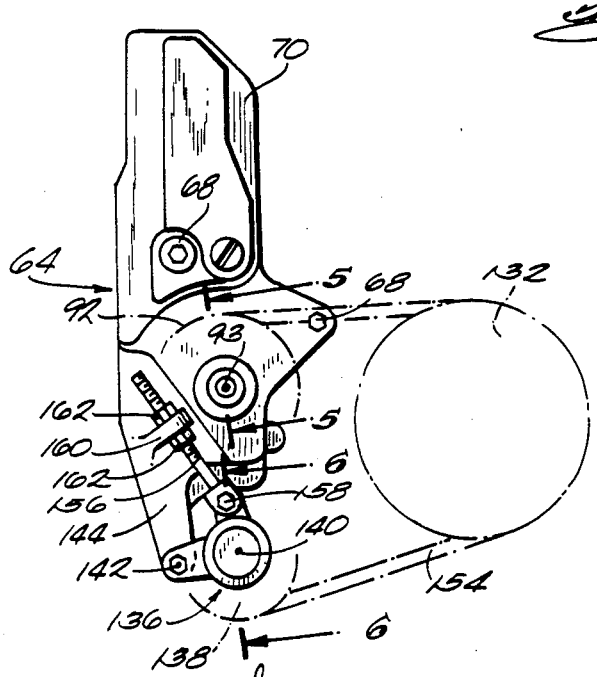
FIG. 4 is an enlarged top view of the pump.

The marine propulsion device 10 further comprises means for adjusting the spacing between the idler pulley 138 and one of the power takeoff pulley 132 and the drive shaft pulley 92 so as to adjust the tension on the belt 154. While various suitable adjusting means can be employed, in the preferred embodiment, the adjusting means includes means for adjusting the angular position of the idler assembly 136 about the axis 142 so as to adjust the distance between the drive shaft pulley 92 and the idler pulley 138. More particularly, in the preferred embodiment, the means for adjusting the angular position of the idler assembly 136 includes (see FIGS. 2–4) a linkage 156 having one end adjustably connected to the pump 64, and an opposite end pivotally connected to the idler assembly 136 for pivotal movement about a generally vertical axis 158 (see FIG. 4) spaced from the axis 142 and from the idler pulley axis 140. In the illustrated construction, the reservoir housing 70 includes an upwardly extending tab 160 having a bore therein, and the one end of the linkage 156 extends through the bore and is adjustably connected to the pump 64 by a pair of nuts 162 (FIG. 4).

Figure 11:
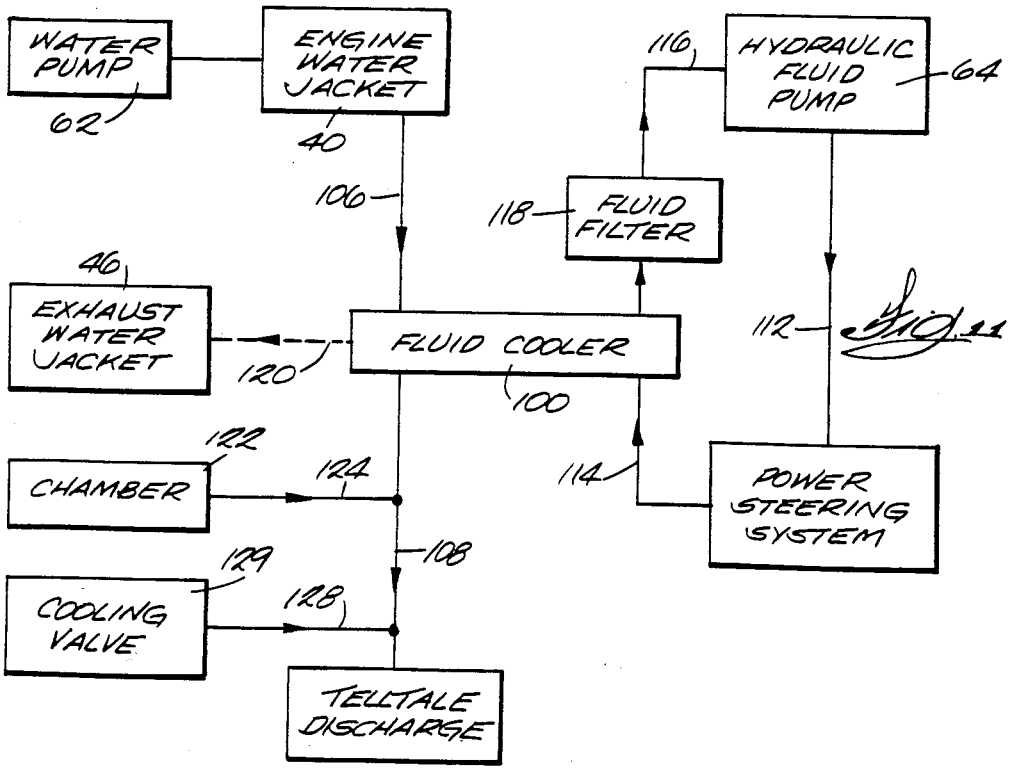
FIG. 11 is a schematic diagram of the hydraulic fluid and water systems of the marine propulsion device.

The marine propulsion device water and hydraulic fluid systems are shown schematically in FIG. 11. To summarize, water flows from the water pump 62 and the water jacket 40 to the fluid cooler 100 through the first conduit 106, and flows from the fluid cooler 100 to the telltale discharge outlet through the second conduit 108. Water is also drained from the fluid cooler 100 to the exhaust water jacket 46 through the third conduit means 120. Water from the housing chamber 122 is siphoned into the second conduit 108 through the siphon conduit 124, and water from the cooling system control valve drains into the second conduit 108 through the fourth conduit means 128. Hydraulic fluid flows from the fluid pump 64 to the power steering system through the supply conduit 112, and flows from the power steering system to the fluid cooler 100 through the first return conduit 114. Hydraulic fluid flows from the fluid cooler 100 back to the fluid pump 64 through the second return conduit 116, which communicates with the fluid filter 118.

Figure 12:
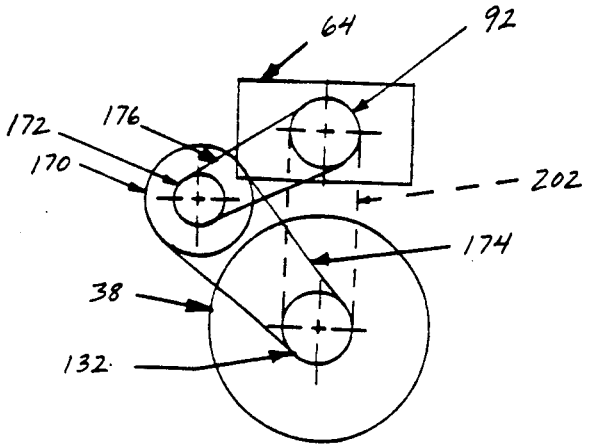
FIG. 12 is a schematic diagram of an alternative embodiment of the invention.

In the preferred embodiment, the pump drive shaft 90 is driven at an rpm higher than the rpm of the crankshaft 34, because the pulley 92 has a circumference less than the circumference of the power takeoff pulley 132. Illustrated in FIG. 12 is an alternative embodiment of the invention in which the pump drive pulley 92 is driven at an rpm less than the rpm of the crankshaft 34. In the alternative embodiment, the power takeoff pulley 132 has a circumference approximately equal to the circumference of the pump drive pulley 92, and the power takeoff pulley 132 is drivingly connected to the pump drive pulley 92 by an intermediate reducing pulley arrangement. The reducing pulley arrangement includes a large pulley 170 having a circumference greater than the circumference of the power takeoff pulley 132, and a small pulley 172 rotating in common with the large pulley 170 and having a circumference less than the circumference of the large pulley 170 and less than the circumference of the pump drive pulley 92. The power takeoff pulley 132 is drivingly connected to the large pulley by a belt 174, and the small pulley 172 is drivingly connected to the pump drive pulley 92 by a belt 176. The large pulley 170 and small pulley 172 can be rotatably mounted in any convenient fashion, and any desired means can be used for adjusting the tension on the belts 174 and 176.

Figure 13:
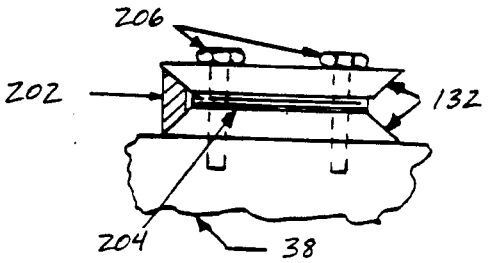
FIG. 13 is a partial side view, partially in cross-section, of an alternative embodiment of the invention.

In an alternative embodiment of the invention illustrated in FIG. 13, the pump 64 is driven by a power takeoff pulley 132 mounted on top of the flywheel 38. The power takeoff pulley 132 is drivingly connected to the pump drive pulley 92 by a V-belt 202. This is shown in dotted lines in FIG. 12. In order to provide means for adjusting the tension on the belt 202, the power takeoff pulley 132 is a split pulley including upper and lower portions separated by belt tension adjusting shims 204. The upper and lower portions of the pulley 132 and the shims 204 are secured to the top of the flywheel 38 by screws 206. By adding or removing shims 204 from between the upper and lower portions of the pulley 132, the effective diameter of the pulley 132 is respectively decreased or increased.

Various features and advantages of the invention are set forth in the following claims.

I claim:

1. A marine propulsion device comprising a propulsion unit adapted to be pivotally mounted on the transom of a boat for pivotal movement relative to the transom about a steering axis, said propulsion unit including a rotatably mounted propeller, and an engine drivingly connected to said propeller, and a pump mounted on said engine and including a reservoir housing defining a reservoir for storing oil to be pumped, and a pump housing defining a pump chamber located below said reservoir housing, an inlet communicating directly between said reservoir and said pump chamber so as to supply oil directly from said reservoir to said pump chamber, an impeller located in said pump chamber, and a pump drive shaft driven by said engine and extending through said resrvoir housing and drivingly connected to said impeller.

2. A marine propulsion device as set forth in claim 1 wherein said pump chamber is located beneath said reservoir, and wherein said pump drive shaft extends generally vertically through said reservoir housing and has a lower end drivingly connected to said impeller.

3. A marine propulsion device as set forth in claim 2 wherien said reservoir housing has a lower end, and wherein said pump housing is mounted on said lower end of said reservoir housing with said pump chamber in communication with said reservoir.

4. A marine propulsion device as set forth in claim 1 wherein said reservoir housing includes a wall surface defining a generally vertical drive shaft passage extending through said reservoir housing in spaced relation to said reservoir and having a lower end communicating with said pump chamber to allow fluid to flow into said drive shaft passage, wherein said pump drive shaft extends through said drive shaft passage, and wherein said pump further includes means sealing said upper end of said drive shaft passage around said drive shaft.

5. A marine propulsion device as set forth in claim 1 wherein said propulsion unit is also mounted for pivotal movement through a trim range relative to the transom about a generally horizontal tilt axis located forwardly of said pump, wherein said pump has a foremost and lowermost portion, and wherein said pump chamber is located in said foremost and lowermost portion of said pump so that said pump chamber is beneath said reservoir throughout said trim range.

6. A marine propulsion device comprising a propulsion unit including a rotatably mounted propeller, and an engine including an engine block having a back and a side, and a generally vertical crankshaft rotatably mounted in said engine block and having an upper end extending upwardly from said engine block, and a lower end drivingly connected to said propeller, a power takeoff pulley mounted on said upper end of said crankshaft, a pump mounted on said side of said engine block and including a generally vertical pump drive shaft having mounted thereon a drive shaft pulley and a pump impeller, an idler pulley mounted on one of said engine block and said pump for rotation about a generally vertical idler pulley axis, and a single belt extending around said power takeoff pulley, said drive shaft pulley, and said idler pulley and drivingly connecting said power takeoff pulley to said drive shaft pulley.

7. A marine propulsion device as set forth in claim 6 wherein said engine further includes a flywheel mounted on said upper end of said crankshaft, and wherein said power takeoff pulley is mounted on said flywheel.

8. A marine propulsion device as set forth in claim 6 wherein said engine further includes a flywheel mounted on said upper end of said crankshaft above said power takeoff pulley, wherein said flywheel has a circumference, and wherein said belt means has a length greater than said circumference.

9. A marine propulsion device as set forth in claim 6 wherein said idler pulley is mounted on said pump.

10. A marine propulsion device as set forth in claim 8 wherein said power takeoff pulley has a circumference less than said flywheel circumference.

11. A marine propulsion device as set forth in claim 6 and further comprising means for adjusting the spacing between said idler pulley and one of said power takeoff pulley and said drive shaft pulley.

12. A marine propulsion device as set forth in claim 11 and further comprising an idler assembly having said idler pulley rotatably mounted thereon and being pivotally mounted on said pump for pivotal movement relative to said pump about a first generally vertical axis spaced from said idler pulley axis, and wherein said adjusting means includes means for adjusting the angular position of said idler assembly about said first axis.

13. A marine propulsion device as set forth in claim 12 wherein said means for adjusting the angular position of said idler assembly includes a linkage having one end adjustably connected to said pump, and an opposite end pivotally connected to said idler assembly for pivotal movement about a generally vertical axis spaced from said first axis and from said idler pulley axis.

14. A marine propulsion device comprising a propulsion unit including a rotatably mounted propeller, and an engine including an engine block, and a generally vertical crankshaft rotatably mounted in said engine block and having an upper end extending upwardly from said engine block, and a lower end drivingly connected to said propeller, a flywheel mounted on said upper end of said crankshaft and including a periphery, a power takeoff pulley mounted on said upper end of said crankshaft, a pump mounted on said engine block and including a generally vertical pump drive shaft, a drive shaft pulley mounted on said drive shaft and having a periphery overlapping said flywheel periphery, an idler pulley mounted on one of said engine block and said pump for rotation about a generally vertical idler pulley axis, and means extending around said power takeoff pulley, said drive shaft pulley, and said idler pulley and drivingly connecting said power takeoff pulley to said drive shaft pulley.

15. A marine propulsion device as set forth in claim 14 wherein said pump drive shaft has an axis located outside said flywheel periphery and wherein said idler pulley axis is also located outside said flywheel periphery.

16. A marine propulsion device in accordance with claim 15 wherein said idler pulley has a periphery overlapping said flywheel periphery.

17. A marine propulsion device comprising a propulsion unit including a rearwardly located and rotatably mounted propeller, and an engine including an engine block having a back and a side, and a generally vertical crankshaft rotatably mounted in said engine block and having a lower end drivingly connected to said propeller, a pump and reservoir assembly including a pump and a reservoir for storing a substantial amount of oil to be directedly supplied to said pump, means on said side of said engine block for mounting said pump and reservoir assembly in adjacent relation to said side of said engine block, belt drive means for driving said pump by said engine, and a cowl enclosing said engine, said pump and reservoir assembly, and said belt drive means.

18. A marine propulsion device as set forth in claim 17 and further comprising a pulley driven by said engine, and wherein said belt drive means is driven by said pulley.

19. A marine propulsion device as set forth in claim 18 wherein said pulley is mounted on said crankshaft.

20. A marine propulsion device as set forth in claim 18 wherein said crankshaft has an upper end extending upwardly from said engine block, and wherein said pulley is mounted on said upper end of said crankshaft.

21. A marine propulsion device as set forth in claim 18 wherein said crankshaft has an upper end extending upwardly from said engine block, and wherein said engine further includes a flywheel mounted on said upper end of said crankshaft, and wherein said pulley is mounted on and beneath said flywheel.

22. A marine propulsion device as set forth in claim 21 wherein said flywheel has a circumference, and wherein said belt means has a length greater than said circumference.

23. A marine propulsion device as set forth in claim 17 wherein said pump includes an impeller, and a generally vertical pump drive shaft having mounted thereon said impeller and a drive shaft pulley, and wherein said belt means drives said driveshaft pulley.

24. A marine propulsion device as set forth in claim 17 wherein said pump is removably mounted on said side of said engine block.

25. A marine propulsion device comprising a propulsion unit adapted to be pivotally mounted on the transom of a boat for pivotal movement relative to the transom about a steering axis, and for pivotal movement through a trim range relative to the transom about a generally horizontal tilt axis, said propulsion unit including a rearwardly located and rotatably mounted propeller, and an engine drivingly connected to said propeller and including a rear and a side, and a pump mounted on said side of said engine and including a housing assembly defining a pump chamber and a reservoir for storing a substantial amount of oil to be pumped, said pump being located relative to said tilt axis and said pump chamber being located relative to said reservoir such that said pump chamber is beneath said reservoir throughout said trim range, and an impeller rotatably mounted in said pump chamber and driven by said engine.

26. A marine propulsion device as set forth in claim 25 wherien said pump has a foremost and lowermost portion, wherein said tilt axis is located forwardly of said pump, and wherein said pump chamber is located in said foremost and lowermost portion of said pump.

27. A pump comprising a housing assembly including a reservoir housing including a lower surface and defining a reservoir having an outlet in said lower surface, and a pump housing located below said reservoir housing and including an upper surface engaged with said lower surface, said pump housing defining a pump chamber and having an inlet in said upper surface communicating with said reservoir outlet and with said pump chamber, an impeller located in said pump chamber, and a pump drive shaft drivingly connected to said impeller.

28. A pump as set forth in claim 27 wherein said pump drive shaft extends generally vertically through said reservoir housing and has a lower end drivingly connected to said impeller.

29. A pump as set forth in claim 28 wherein said reservoir housing has a lower end, and wherein said pump housing is mounted on said lower end of said reservoir housing with said pump chamber in communication with said reservoir.

30. A pump as set forth in claim 27 wherein said reservoir housing includes a wall surface defining a generally vertical drive shaft passage extending through said reservoir housing in spaced relation to said reservoir and having a lower end communicating with said pump chamber to allow fluid to flow into said drive shaft passage, wherein said pump drive shaft extends through said drive shaft passage, and wherein said pump further comprises means sealing said upper end of said drive shaft passage around said drive shaft.

31. A pump comprising a housing assembly including a reservoir housing defining therein a reservoir for storing oil to be pumped, a pump housing located below said reservoir housing and defining a pump chamber, an impeller rotatably mounted in said pump chamber, and a pump drive shaft extending through said reservoir housing in laterally spaced relation to and exteriorly of said reservoir therein and having an end drivingly connected to said impeller.

32. A marine propulsion device comprising a propulsion unit including a rearwardly located and rotatably mounted propeller, and an engine including an engine block having a top, a bottom, a back, and a side, and a generally vertical crankshaft rotatably located in said engine block and having a lower end drivingly connected to said propeller, a pump and reservoir assembly including a pump and a reservoir for storing a substantial amount of oil to be directly supplied to said pump, means for mounting said pump and reservoir assembly on said side of said engine block above said bottom and, at least in part, below said top thereof, and belt drive means for driving said pump by said engine.

33. A marine propulsion device comprising a propulsion unit adapted to be pivotally mounted on the transom of a boat for pivotal movement relative to the transom about a steering axis and including a rotatably mounted propeller, an engine drivingly connected to said propeller, and a pump assembly including a reservoir housing defining a reservoir for storing oil to be pump, a pump housing defining a pump chamber located below said reservoir housing and including an inlet communicating directly with said reservoir so as to supply oil directly from said reservoir to said pump chamber, an impeller located in said pump chamber, and a pump drive shaft extending through said reservoir housing and having a first end drivingly connected to said impeller and a second end having thereon a pulley driven by said engine.

34. A marine propulsion device comprising a propulsion unit including a rotatably mounted propeller, and an engine including an engine block having a back and a side and a crankshaft rotatably mounted in said engine block and having an upper end extending upwardly from said engine block, and a lower end drivingly connected to said propeller, a power takeoff pulley mounted on said upper end of said crankshaft, a flywheel mounted on said upper end of said crankshaft above said power takeoff pulley, a pump mounted on said side of said engine block and including a pump drive shaft having mounted thereon a drive shaft pulley, an idler pulley mounted on one of said engine block and said pump for rotation about an idler pulley axis, and a single belt extending around said power takeoff pulley, said drive shaft pulley, and said idler pulley and drivingly connecting said power takeoff pulley to said drive shaft pulley.

* * * * *